United States Patent [19]

Rosenberg

[11] 3,937,163

[45] Feb. 10, 1976

[54] LAUNCH AND RECOVERY VESSEL

[76] Inventor: Edgar N. Rosenberg, 6914 Mission Gorge Road, San Diego, Calif. 92120

[22] Filed: Jan. 31, 1975

[21] Appl. No.: 545,947

[52] U.S. Cl. ..... 114/43.5 UC; 114/51
[51] Int. Cl.[2] ..... B63C 1/12; B63B 35/40
[58] Field of Search..... 114/43.5 UC, 51, 61, 16.4, 114/16.8; 254/135 R, 137

[56] References Cited

UNITED STATES PATENTS

| | | | |
|---|---|---|---|
| 2,347,690 | 5/1944 | Kannenberg | 114/51 |
| 3,512,657 | 5/1970 | Chambers | 254/135 R X |
| 3,536,023 | 10/1970 | Toher et al. | 114/43.5 |
| 3,807,335 | 4/1974 | Talkington | 114/43.5 |

*Primary Examiner*—Trygve M. Blix
*Assistant Examiner*—Gregory W. O'Connor
*Attorney, Agent, or Firm*—Richard S. Sciascia; Ervin F. Johnston

[57] ABSTRACT

An apparatus for and method of docking and recovering a submersible by a surface vessel reduces the possibility of damaging the submersible and injuring the crewmen. The submersible approaches its catamaran recovery vessel from between the sterns of the twin hulls. Both craft continue to proceed underway and a yoke connected to opposite sides of a well cover is coupled to the nose of the submersible. As the well cover is slid forward to expose a recovery well, the submersible is towed forward. One end of a hoisting cable is attached to the submersible and the other end is connected to a biased hydraulic-ratchet purchase. The submersible is buoyed to the water-air interface and, as it pitches and heaves in response to surface wave action, the hydraulic-ratchet keeps the cable taut. This gradually lifts the submersible through the water-air interface because the hydraulic-ratchet is designed to allow only upward motion. A source of pressurized hydraulic fluid coupled to the hydraulic-ratchet hoists the submersible on board and sets it on deck. Since both vessels are underway, the yoke prevents collision. Coupling the hoisting cable to the biased hydraulic-ratchet purchase guards against the hoisting cable's being snapped during recovery. With these two hazards overcome, safer undersea operations are assured.

13 Claims, 8 Drawing Figures

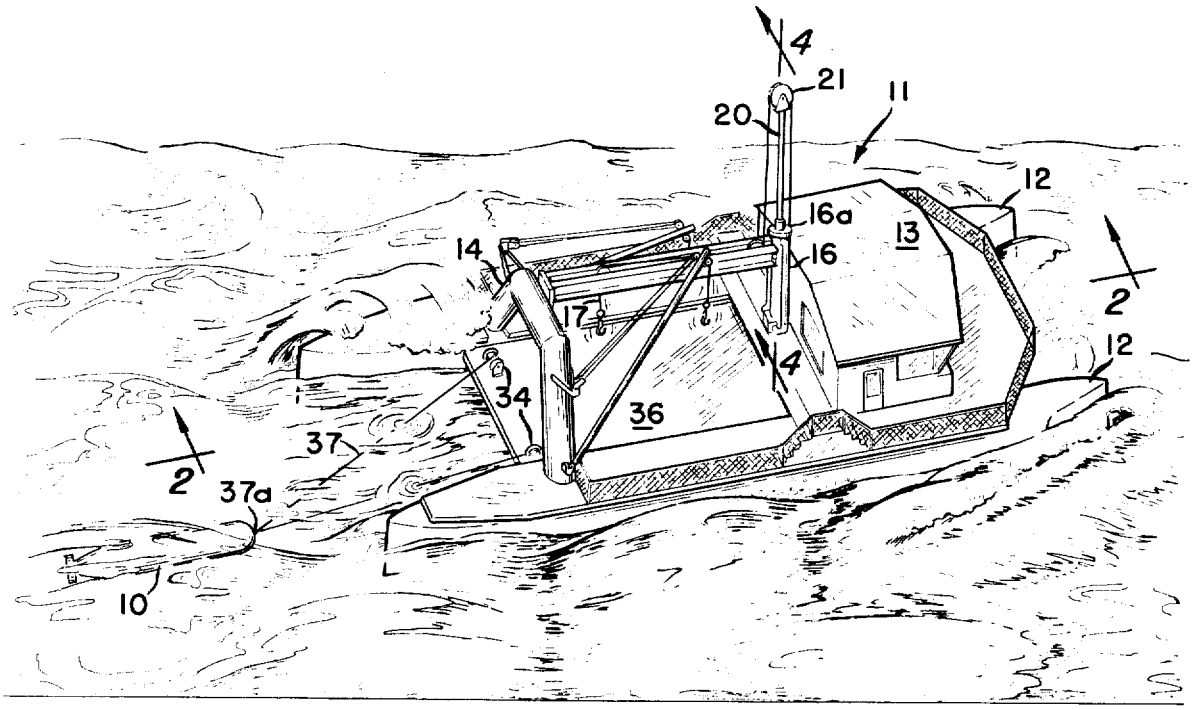
FIG. 1
FIG. 2
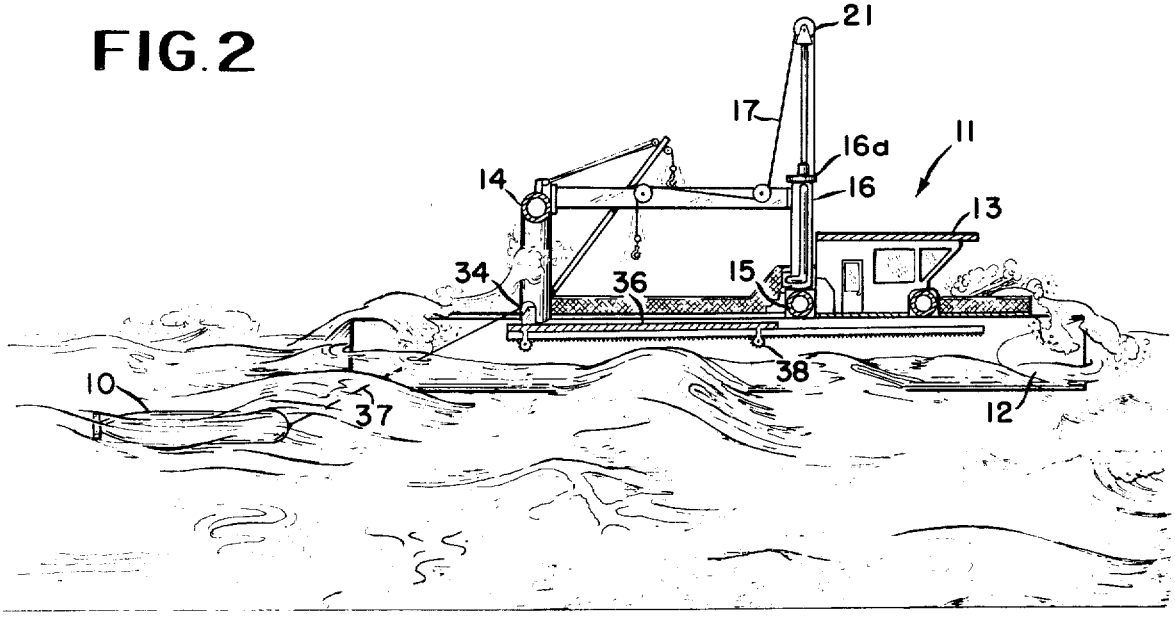

LAUNCH AND RECOVERY VESSEL

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A variety of support ships with hoisting apparatuses have been used and proposed. Some of these use no more than a conventional surface vessel provided with a crane. The arrangement is not totally satisfactory since the relative motions between the submersible and the support vessel create excessive acceleration forces during the lifting or lowering of the submersible. These forces batter the submersible and crewmen alike. Another hazard is that the possibility of collision is ever present because one vessel usually is stationary while the other attempts to manuever into a recovery position. Another approach calls for docking the submersible onto a submerged platform or submarine. The trouble here, however, is that the submerged recovery platform is uncontrollable. That is to say, when the submerged recovery platform does not extent through the water-air interface nor does it rest on the bottom, it is extremely unstable. Being neutrally buoyant and at rest, it offers no resistance and does not provide counteracting forces during a launching or recovery. In addition, the submerged platform is tied to this single specific use. The need therefore exists in the state of the art for an apparatus for and a method of safely recovering a submersible by a surface craft that does not endanger equipment and crewmen.

SUMMARY OF THE INVENTION

The present invention is directed to providing an apparatus for and a method of docking and recovering a submersible by a surface vessel. The submersible is positioned within a downward projection of a well provided in the surface vessel and a hoisting cable is connected to the submersible. The other end of the cable is connected to a two-for-one hydraulic-ratchet purchase and the submersible is lifted through the water-air interface by the cable as the submersible responds to surface wave action. Coupling a source of pressurized hydraulic fluid to the hydraulic-ratchet allows its further extension and the hoisting of the submersible on board the surface vessel.

An object of the invention is to provide an improved apparatus for recovering a submersible through the water-air interface.

Another object of the invention is to provide a safer recovery system.

Another object is to provide a recovery method and apparatus which avoids jerking the submersible as it makes its transition through the water-air interface.

Another object of the invention is to provide a method and apparatus for recovery of a submersible which reduces the possibility of damaging the submersible or injuring its occupants.

Yet another object is to provide a submersible recovery apparatus which takes advantage of a submersible's heaving and pitching motions to facilitate its recovery.

Still another object is to provide a submersible recovery system which is capable of functioning in relatively high sea states.

These and other objects of the invention will become more readily apparent from the ensuing specification when taken with the drawings.

BRIEF DESCRIPTION OF THE DRAWINGS

FIG. 1 is an isometric view of the invention at an initial stage of submersible recovery.

FIG. 2 is a cross-sectional side view of the invention taken along lines 2—2 in FIG. 1 showing the well cover at an aft position and the submersible approaching submerged.

DESCRIPTION OF THE PREFERRED EMBODIMENT

Figure 3:
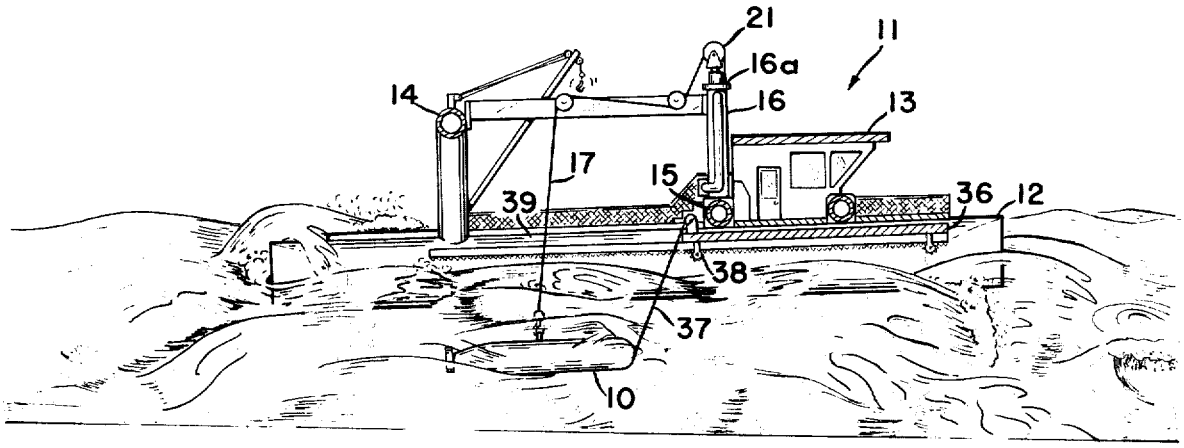
FIG. 3 is a cross-sectional representation taken along the same longitudinal plane as FIG. 2 showing the well cover moved forward and the submersible disposed below the water-air interface.

Referring now to FIG. 1 of the drawings, there is shown a submersible 10 returning from the depths to its surface support vessel 11. The submersible is any one of a growing family of undersea craft capable of carrying a crew to ocean depths for the performance of work or scientific observations. Preferably, to more thoroughly demonstrate the advantages of the present invention, the submersible has an elongate shape with its main propulser located at its stern. A submersible of the type such as the deep submergence rescue vehicle (DSRV) is a design which will adapt itself to functionally demonstrate the salient features of this invention.

The surface vessel depicted in the drawings is basically a conventional catamaran craft. Its two hulls 12 have a sufficient separation and length to span successive waves so that the vessel remains relatively stable in normal sea states. A cabin or bridge 13 is located forward and extends between the two hulls. At least one structural member 14 reaches between the aft portions of the hulls and a forward structural member 15 located just behind the bridge, lends structural integrity to the forward part of the vessel.

An essential element of the invention, a biased hydraulic-ratchet purchase 16 is mounted securely on the forward structural member and partially functions as the anchoring point **16*a* of a hoisting cable 17**.

Figure 4:
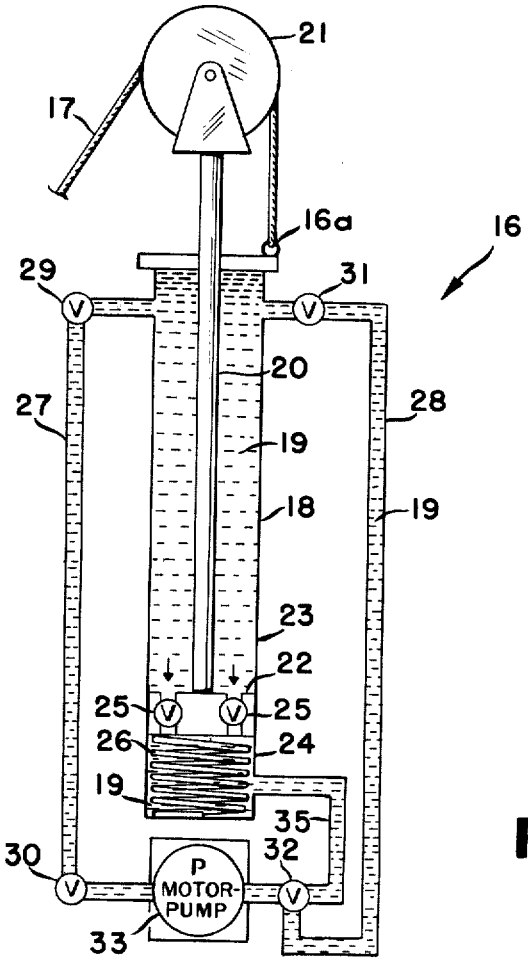
FIG. 4 is a cross-sectional view of a hydraulic-ratchet purchase and a hydraulic pump taken generally along lines 4—4 in FIG. 1.

Referring ahead to FIG. 4, the hydraulic-ratchet purchase includes an elongate cylindrically shaped housing 18 filled with hydraulic fluid 19. A shaft 20 is appropriately sealed where it extends from the housing and a sheave 21 is journaled in the far end of the shaft to serve as a guide for the hoisting cable.

At the opposite end of the shaft, a piston 22 is slidably retained in the cylindrically shaped housing. The piston is sized to substantially create a seal between its shaft side 23 and its piston face side 24. Traversely disposed in the piston, there are provided several one-way valves 25 which permit only the flow of hydraulic fluid from shaft side 23 to piston face side 24.

The one way flow of the hydraulic fluid occurs when there is an insufficient loading of sheave 21 and the force exerted by a compressed coiled biasing spring 26 moves piston 22 along with shaft 20 upward. A sufficient loading to prevent extension of the biasing spring exists when submersible 10 is supported by the opposite end of the hoisting cable. When so loaded, the one-way valves close and downward motion by the sheave-shaft-piston arrangement is arrested.

The biased hydraulic-ratchet purchase further includes a pair of bypass conduits 27 and 28 which contain check valves 29, 30, 31 and 32. Check valves 29, 30 and 31 have a flow-no-flow capability whereas check valve 32 is selectably actuated to shut off the flow of hydraulic fluid to and from conduit 28 or to and from a feedback duct 35. The hydraulic fluid comes from an interconnected source of hydraulic pressure 33 which is no more than a motor-pump combination coupled to a hydraulic fluid sump.

The purpose and function of the check valves, conduits and duct are to permit a controlled extension and withdrawal of the purchase prior to, during and after a docking and recovery operation. This co-action will be elaborated on below.

A pair of winches 34 are mounted on the lateral aft extremes of a longitudinally displaceable well cover 36. A line yoke 37 is played out from the winches to trail between and behind the twin hulls. The line optionally is weighted or of a wire rope construction so that it arcs downwardly. When so disposed, vertex 37*a* of the yoke is positioned to be engaged by a suitable clamping mechanism carried on the nose of the submersible.

Once this engagement is made, the winches reel in a portion of the yoke and the submersible is hauled in-between the hulls, see FIG. 2. It should be noted that a sufficient length of the yoke remains played out to locate the submersible below the water-air interface. Since both vessels are under way, the yoke prevents any contact between them.

At this point in the docking and recovery operation longitudinally displaceable well cover 36 is at its aftermost position. A displacement assembly 38, which optionally is no more than a powdered rack and pinion mechanism carried on the inside of both hulls, is actuated to move the well cover forward, see FIG. 3. Movement of the hatch cover to its forward position simultaneously accomplishes two things. First, a recovery well 39 is exposed. Secondly, the forwardly moving well cover tows the submersible into the recovery well via yoke 37. It will be noted that both the support vessel and the submersible are still forwardly moving and that the submersible is below the level of surface wave action. The forward motion by both craft and the arc of the yoke ensure that there will be no damage to either craft.

At this time in the docking and recovery sequence, hoisting cable 17 is securely connected to the submersible preferably at a vertical extension of the submersible's centroid. The exact technique employed in making this connection only requires using any of several well known interconnection devices; however, one in particular has proven to be most effective. This device is the "Mechanical Retriever," of U.S. Pat. No. 3,853,082 jointly invented by Edgar N. Rosenberg and Stephen F. Moran. The submersible plays out a marker buoy line and the Rosenberg-Moran retriever is pulled down onto the submersible to expeditiously attach a hoisting cable.

Next, hydraulic fluid source 33 feeds pressurized fluid through both check valves 30 and 32. These valves along with check valves 29 and 31 are switched appropriately and pressurized fluid flows to shaft side 23 in cylindrically shaped housing 18, while check valve 32 is rotated to return hydraulic fluid from piston face side 24 to the hydraulic fluid source. Because a sufficient hydraulic pressure is fed to shaft side 23 a downward motion by piston 22, shaft 20 and sheeve 21 is imparted. This downward motion compresses biasing spring 26 and sets the hydraulic ratchet purchase.

During the setting operation just described, a portion of the hydraulic fluid continues to flow through one-way valves 25. However, the valves are sized so that the volume of flow through them is much less than the volume flow capability of two conduits 27 and 28 and hydraulic pressure source 33. Consequently, a pressure differential is created across the piston from a shaft side 23 to piston face side 24. It is this pressure differential that overcomes the biasing force of biasing spring 26 and the resultant setting of hydraulic-ratchet purchase 16. After the slack has been taken out of the hoisting cable, for example, at its anchoring point 16*a*, check valves 29, 30, 31 and 32, switch conduits 27 and 28 and duct 35 out of the circuit. Now, the biasing force of spring 26 urges sheave 21 upward and tension is exerted by the hoisting cable.

Since the hoisting cable passes over sheave 21, each unit of measurement of the sheave rises imparts a two unit vertical displacement of the hoisting cable where it is connected to the submersible. A two-for-one purchase has been effected by the biased hydraulic-ratchet purchase to facilitate recovery of the submersible.

Figure 5:
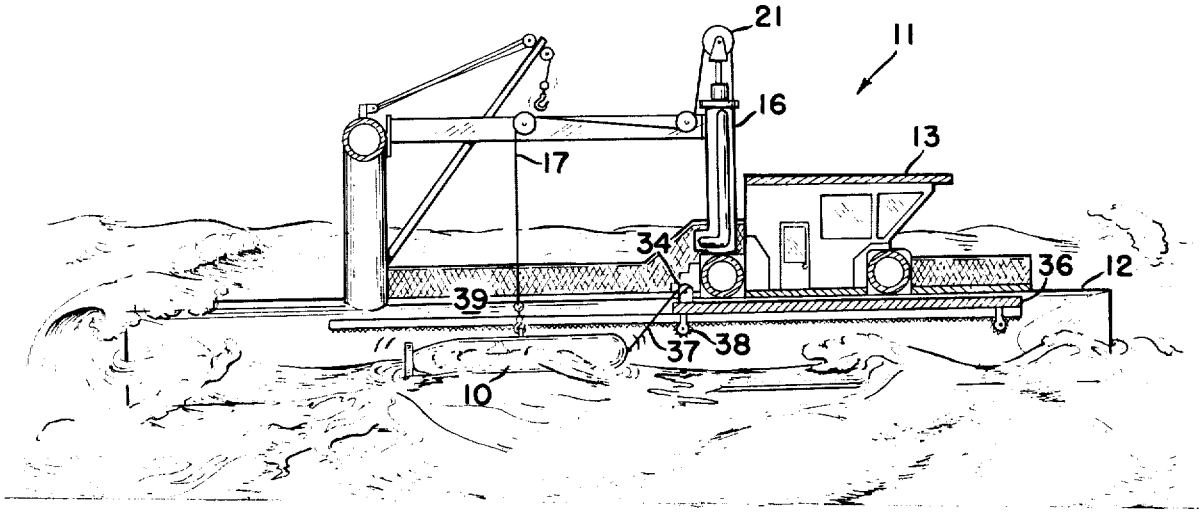
FIG. 5 is a cross-sectional view showing the submersible at the water-air interface and the hoisting cable attached to the hydraulic-ratchet purchase which is in the set position.
Figure 6:
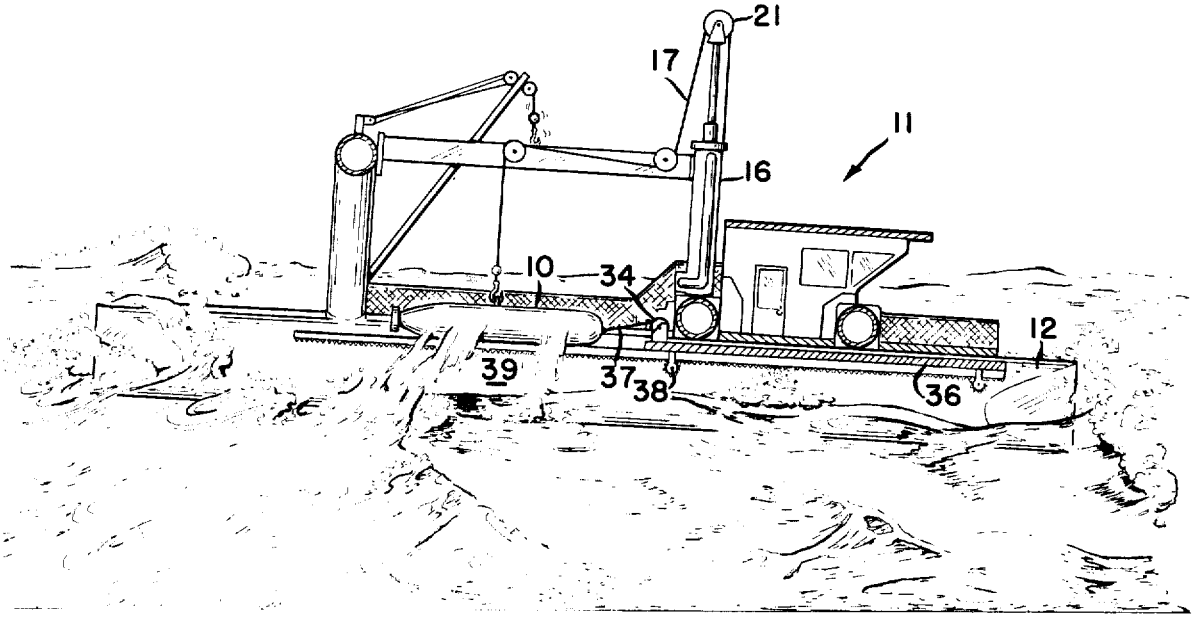
FIG. 6 is a cross-sectional representation depicting the submersible emerging through the water-air interface and the hydraulic-ratchet purchase partially extended.

As the submersible approaches the water-air interface, see FIG. 5, surface wave action causes the submersible to pitch and heave. However, once the submersible is buoyed upward, one way valves 25 in the piston prevent the interconnected piston-shaft-sheave assembly from retreating downward. In other words, after the submersible has been buoyed to the crest of a swell, it is retained from subsequent downward motion into a following trough since the hydraulic-ratchet purchase takes up any slack in the hoisting cable. The taking up of slack along with tension exerted by yoke 37 centers the submersible in the recovery well. Since both craft are moving forward the submersible is prevented from yawing and damaging either craft. In this manner, the pitching and heaving motions imparted to the submersible by surface wave action safely lift the submersible partially through the area of surface turbulence, see FIG. 6.

At this point of ascent, check valves 29, 30, 31 and 32 are rotated to channel the flow of pressurized hydraulic fluid in the opposite direction to the flow path when the hydraulic-ratchet purchase was set. Now, the pressure differential across piston 22 is from an area of higher pressure on piston face side 24 to an area of lower pressure on shaft side 23. One-way valves 25 close and the piston-shaft-sheeve assembly rises and is drawn in at a two-for-one rate and serves to complete the recovery.

Figure 7:
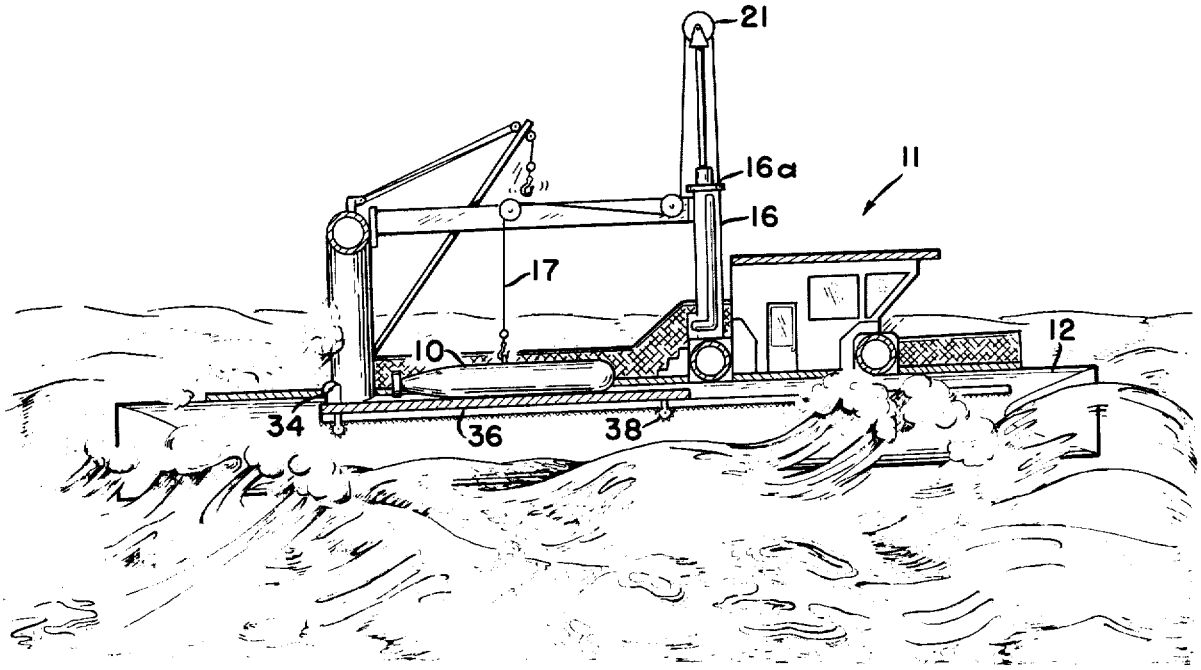
FIG. 7 is a cross-sectional representation of the submersible resting on the well cover and the hydraulic-ratchet purchase further extended.

After the submersible is raised by the hydraulic-ratchet purchase above the level of the twin hulls, rack and pinion mechanism 38 slides well cover 36 back to its original position. Immediately beforehand, however, yoke 37 is decoupled from the submersible and the well cover is returned to its aft position. By a controlled reverse flow of hydraulic fluid through proper actuation of the check valves, the hydraulic-ratchet purchase lowers the submersible to rest gently on top of the well cover, see FIG. 7. All that remains is that the necessary steps be taken to secure the submersible in place as the surface support vessel continues to proceed underway.

Figure 8:
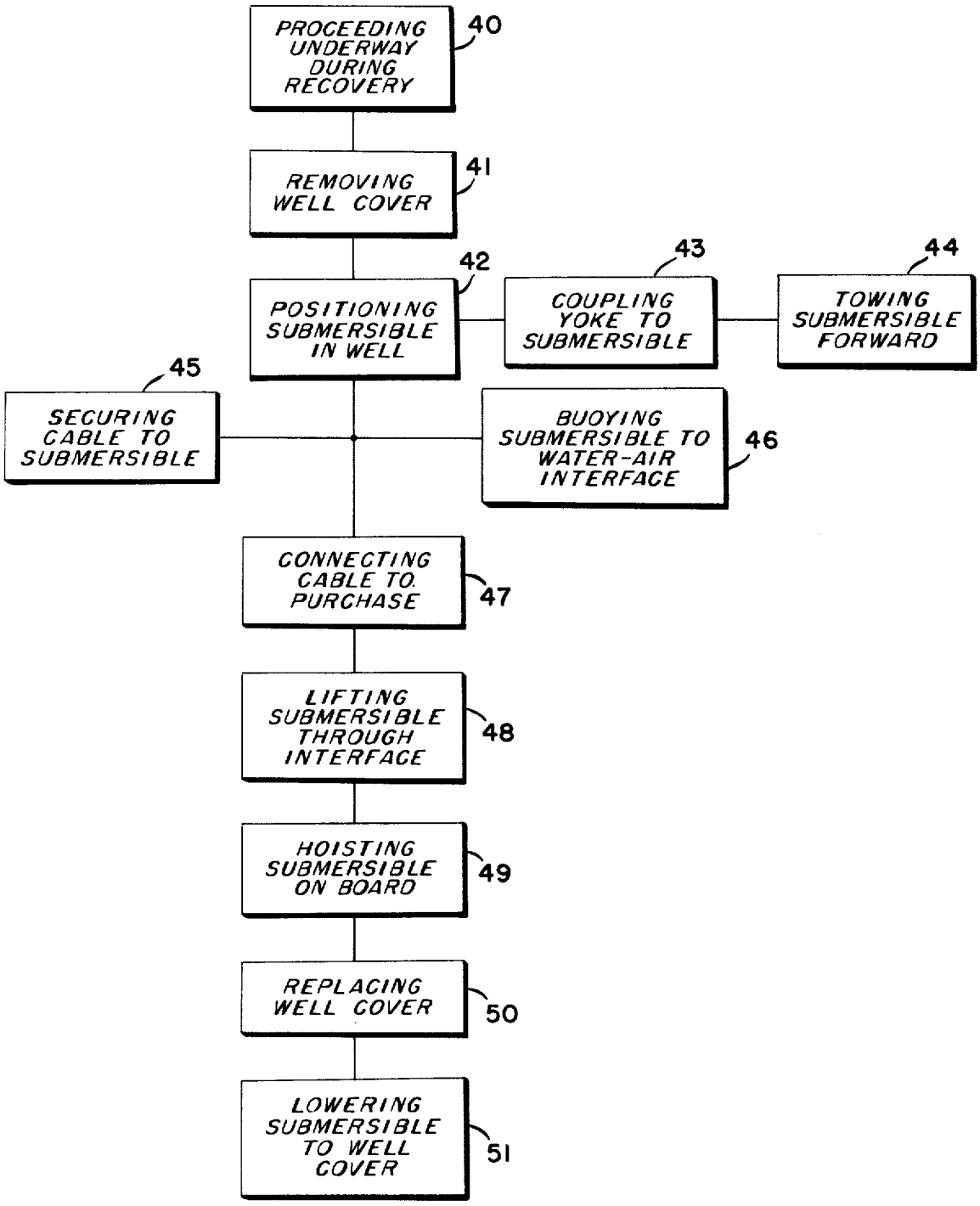
FIG. 8 is a diagram, in block form, of the method of safe recovery provided by the disclosed apparatus.

While there has been disclosed the apparatus for ensuring the safe recovery of a submersible, it is evident that in practice this apparatus provides a method of such recovery, see FIG. 8. First, there is the proceeding underway 40 of both crafts during the recovery operation. A removing 41 of the well cover leads to a positioning 42 of the submersible in the recovery well. This positioning occurs by reason of there being a coupling 43 of a yoke to the submersible and a towing 44 of the submersible forward into the recovery well as the well cover is moved forward.

Once in position in the well, there is a securing 45 of a hoisting cable to the submersible. Immediately thereafter, there is a buoying 46 of the submersible to the water-air interface at which time, if not earlier, a connecting 47 of the hoisting cable to a biased hydraulic-ratchet purchase is made.

Surface wave action creates a lifting 48 of the submersible through the water-air interface and suitably coupling a source of pressurized hydraulic fluid to the hydraulic-ratchet purchase results in a hoisting 49 of the submersible on board the surface support vessel. The yoke is disconnected from the submersible and a replacing 50 the well cover creates a pad upon which the submersible is deposited following a lowering 51 of the submersible to the exposed well cover.

It is apparent that the aforestated sequence of events and the actuation of the disclosed apparatus is reversable in sequence This reversal of sequence permits the deployment and launch of a submersible with all the advantages previously set forth.

The two-for-one purchase disclosed is not mandatory. Any of several equivalent purchases can be substituted, for example a system of sheaves and lines or mechanical ratchets.

Obviously, many modifications and variations of the present invention are possible in the light of the above teachings, and, it is therefore understood that within the scope of the disclosed inventive concept, the invention may be practiced otherwise than specifically described.

What is claimed is:

1. A method of docking and recovering a submersible by a surface vessel comprising:

positioning the submersible within a downward projection of a well provided in the surface vessel;

securing the distal end of a cable to the submersible;

connecting the bitter end of the cable to a two-for-one hydraulic-ratchet purchase;

lifting the submersible through the water-air interface by the cable as the submersible responds to surface wave action; and hoisting the submersible on board the surface vessel.

2. A method according to claim 1 further including:

buoying the submersible to the water-air interface prior to said lifting to allow the submersible to pitch and heave in response to the surface wave action.

3. A method according to claim 2 further including:

proceeding underway by both the submersible and the surface vessel during docking and recovering to ensure a longitudinally parallel relationship between the submersible and the surface vessel during said positioning.

4. A method according to claim 3 further including:

coupling the vertex of a yoke to the submersible and towing the submersible forward during said proceeding underway to further ensure said positioning in said well.

5. A method according to claim 4 further including:

removing a well cover from said well prior to said positioning and said securing and replacing said well cover after said hoisting to provide a stowage area for the submersible.

6. A method according to claim 5 in which said hoisting includes the actuation of a source of hydraulic pressure connected to said hydraulic-ratchet purchase to continue its extension for raising the submersible.

7. A method according to claim 6 further including:

lowering the submersible to rest on said well cover after said replacing.

8. A method according to claim 7 in which the surface vessel is a catamaran and the well is located amidships between the hulls, the well cover is rectangularly shaped and adapted to be moved forward to uncover the well, and the yoke is attached to opposite sides of the rear of the well cover to tow the submersible into the well as the well cover moves forward.

9. A method according to claim 8 in which all the aforestated steps of the method are reversed in sequence to ensure the deploying and launching of a submersible by a surface vessel.

10. An apparatus for docking and recovering a submersible by a catamaran surface vessel comprising:

means for positioning the submersible within a downward projection of a well provided in the surface vessel including a well cover slidably mounted between the hulls of the catamaran, said well cover is longitudinally displaceable forwardly to expose said well and a yoke having its vertex connected to the submersible and its free ends connected to said well cover, said yoke tows the submersible forward between the hulls of the catamaran vessel as said well cover is longitudinally displaced forward;

a cable connected to the submersible at one end;

means connected to the other end of the cable for automatically taking-up-slack in the cable as the submersible responds to surface wave action and for lifting the submersible through the water-air interface as it responds thereto; and means for hoisting the submersible on board the surface vessel.

11. An apparatus according to claim 10 in which the taking-up-slack and lifting means is a two-for-one biased hydraulic-ratchet purchase which holds taut said cable as the submersible pitches and heaves in response to surface wave action and consequently raises the submersible through the water-air interface.

12. An apparatus according to claim 11 further including:

a source of hydraulic pressure coupled to said biased hydraulic-ratchet purchase to further extend it to hoist the submersible from the water and onto a stowage pad.

13. An apparatus according to claim 12 in which said biased hydraulic-ratchet purchase includes, an elongate cylindrical housing, a piston carried in said housing provided with a plurality of one-way valves, a shaft extending from said piston to said cable, a biasing spring carried in said housing urging said shaft toward said cable, and a hydraulic tubing system operatively connected to said housing to reset said hydraulic-ratchet purchase.

* * * * *